US006082867A

United States Patent [19]

Chien

[11] Patent Number: 6,082,867

[45] Date of Patent: Jul. 4, 2000

[54] LIGHTING ARRANGEMENTS INCLUDING A THREE-DIMENSIONAL ELECTRO-LUMINSCENT ELEMENT

[76] Inventor: Tseng-Lu Chien, 8F, No. 29, Alley 73, Lin Shen Street, Shi-Chi Town, Taipei Hseng, Taiwan

[21] Appl. No.: 08/758,393

[22] Filed: Nov. 29, 1996

[51] Int. Cl.[7] ..... H05B 33/00

[52] U.S. Cl. ..... 362/84; 362/103; 362/231; 362/234; 362/156; 313/512; 368/67

[58] Field of Search ..... 368/67, 227, 327; 362/84, 103, 104, 23, 29, 301, 156, 234, 231; 313/503, 510, 511, 512; 40/544

[56] References Cited

U.S. PATENT DOCUMENTS

| | | | |
|---|---|---|---|
| 2,226,748 | 12/1940 | Stephens et al. | 362/30 |
| 3,003,305 | 10/1961 | Goldman | 362/29 |
| 3,754,130 | 8/1973 | Stone et al. | 362/29 |
| 4,217,625 | 8/1980 | Klein | 362/29 |
| 4,527,096 | 7/1985 | Kindlmann | 368/67 |
| 4,601,584 | 7/1986 | DeWolf et al. | 368/327 |
| 4,727,603 | 3/1988 | Howard | 2/243 |
| 4,775,964 | 10/1988 | Alessio et al. | 368/67 |
| 4,895,110 | 1/1990 | LoCascio | 119/106 |
| 4,908,739 | 3/1990 | Brien | 368/67 |
| 4,935,851 | 6/1990 | Wood | 362/103 |
| 5,052,131 | 10/1991 | Rondini | 36/137 |
| 5,067,063 | 11/1991 | Granneman et al. | 362/156 |
| 5,149,489 | 9/1992 | Crews | 362/32 |
| 5,151,678 | 9/1992 | Vetri et al. | 340/321 |
| 5,265,071 | 11/1993 | Thorgensen et al. | 368/67 |
| 5,339,550 | 8/1994 | Hoffman | 362/84 X |
| 5,469,342 | 11/1995 | Chien | 362/84 |
| 5,485,355 | 1/1996 | Voskoboinik et al. | 362/84 |
| 5,515,247 | 5/1996 | Cheung et al. | 362/103 |
| 5,548,565 | 8/1996 | Aoyama et al. | 362/103 |
| 5,552,971 | 9/1996 | Madden | 362/84 X |
| 5,598,382 | 1/1997 | Wilson et al. | 368/67 |
| 5,604,416 | 2/1997 | Cheung | 368/67 |
| 5,734,627 | 3/1998 | Sy | 368/67 |

*Primary Examiner*—Stephen Husar

[57] ABSTRACT

A lighting arrangement includes a three-dimensional electro-luminescent lighting element, the electro-luminescent lighting element being arranged to emit light in multiple directions without deforming the element, and including a center conductor and a coaxial outer conductor having wires that are stripped to form terminals of the lighting element, an electrical circuit connected to the terminals for supplying electrical power to the electro-luminescent lighting element at a frequency and voltage sufficient to cause the electro-luminescent lighting element to emit light, and an attachment structure for attaching the electro-luminescent lighting element to a main object in order to provide illumination for the main object over an arc angle of from 10° to 360°.

34 Claims, 12 Drawing Sheets

FIG. 6A
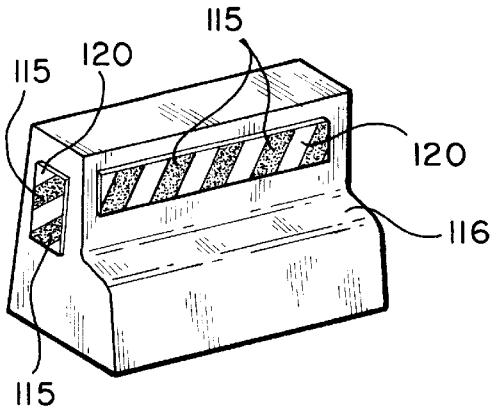
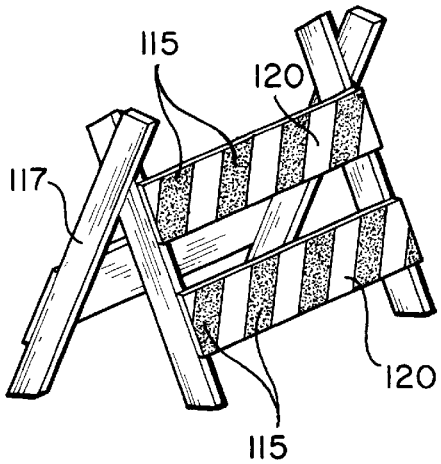
FIG. 6B
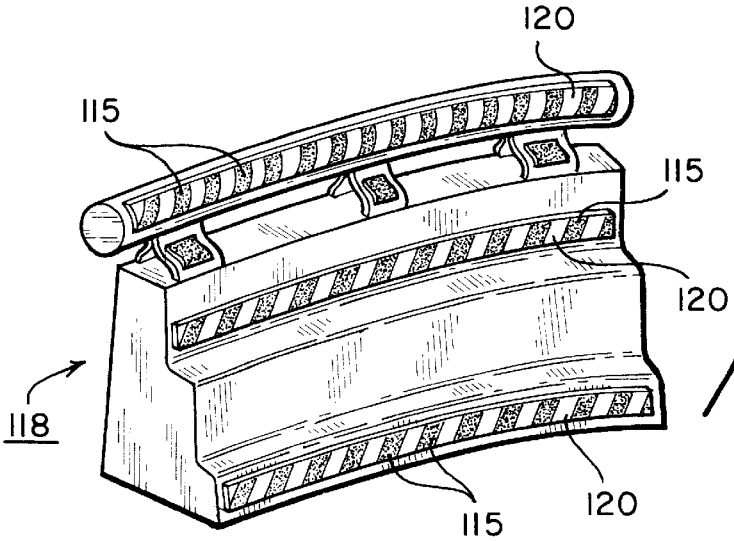
FIG. 6C
FIG. 6D
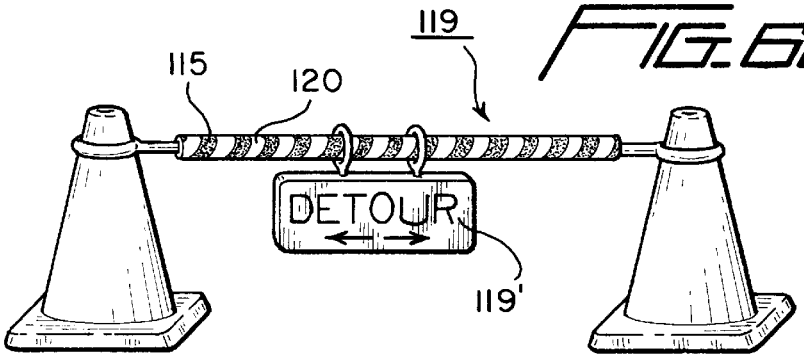

LIGHTING ARRANGEMENTS INCLUDING A THREE-DIMENSIONAL ELECTRO-LUMINSCENT ELEMENT

BACKGROUND OF THE INVENTION

1. Field of the Invention

This invention relates to lighting arrangements utilizing a three-dimensional electro-luminescent lighting element, and to a three-dimensional electro-luminescent lighting element for use in such lighting arrangements.

2. Discussion of Related Art

The advantages of using electro-luminescent lighting elements in a variety of contexts are explained in several copending U.S. patent applications and issued patents of the Inventor. Serial numbers of the copending U.S. patent applications include Ser. Nos. 08/305,294; 08/343,404; 08/343,915; 08/383,404; 08/383,405; 08/409,925; 08/421,647; 08/432,707; 08/438,373; 08/444,064; 08/436,007; 08/444,064; 08/489,160; 08/498,258; 08/510,701; 08/522,940; 08/561,973; 08/611,049; 08/614,001; 08/522,940; 08/712,484; and 08/734,872, and the issued U.S. Pat. Nos. include 5,451,842; 5,469,342; 5,475,574; 5,479,325; 5,566,384, 5,570,946; 5,572,294 and 5,734,336.

The super-thin lighting arrangements described in the above-cited patent applications and patents of the Inventor are generally made up of multiple layers, including a protective backing layer, a conductive layer which forms an electrode, at least one phosphor layer, another conductive layer forming the second electrode, and a transparent protective layer, to form a strip or panel which emits light through either one or both of the protective layers, depending on the number of phosphor layers and the arrangement of the conductive layers. This type of electro-luminescent strip is thinner and more flexible than conventional lighting elements, and as a result is beginning to enjoy widespread popularity for a wide variety of applications.

One commercially available example of such an electro-luminescent strip or panel arrangement is manufactured by Durel Company USA, whose electro-luminescent panels are used in Timex Corporation's INDIGLOO™ watch. The Durel Company electro-luminescent panel is a multi-layer type panel made up of a conductive layer, a dielectric layer, a phosphor layer, and filter layers with micro-encapsulated particles to obtain a thickness of between 0.2 mm and 0.4 mm, and is used to provide background illumination in wristwatches and wall clocks, making use of the large area illumination and low power consumption of the panels.

Despite their advantages, however, the Inventor has discovered that flat electro-luminescent panels of the type discussed above have a number of limitations, which have not been previously appreciated. The main limitation is that the light can only be emitted in a single direction, meaning that to provide backlighting over a large area such as the face of a clock, the panel must extend over substantially the entire area as in the Timex watch, or the panel must somehow be bent so that light from the panel is emitted in an additional direction to illuminate the face of the clock.

While the relative thinness and flexibility of the conventional electro-luminescent panel would appear to permit bending of the panel into a relatively small-diameter cylinder, which would permit light to be emitted over larger angles, in practice the minimum bending radii of the panels, i.e., the smallest bending radius to which the panel can be bent without damaging any of the interior layers of the panel and causing dark spots to appear, is still too large to permit formation of cylindrical lighting elements with sufficient transverse flexibility to make them suitable for use in most applications.

For example, the minimum bending radius for a typical flat panel having a thickness of 0.28 mm is approximately 8.0 mm, and thus to form a cylinder having a length of ymm and a diameter of 16 mm would require a panel of $(16\pi\times y)mm^2$. Such a panel would be both too large for use on a watch, and for most other applications requiring 360° illumination, such as lace illumination arrangements, and yet would require an excessive size of flat panel for the coverage provided by the three-dimensional illumination. As a result, three-dimensional electro-luminescent arrangements made by simply bending a flat electro-luminescent panel are impractical.

In addition, conventional electro-luminescent panels are provided with fixed output terminals which generally must be situated at the edge of the panel, severely restricting choice of panel placement applications which can accommodate the necessary wiring. This is particularly inconvenient for custom designs or do-it-yourself applications, in which it would be advantageous for the consumer to make the terminals rather than having to work around fixed terminals.

Added to the physical limitations of conventional flat panel-type electro-luminescent lighting arrangements are the limitation of offering only a single color per phosphor coating, with multiple coatings needed to provide multi-color effects or to provide two-sided illumination.

SUMMARY OF THE INVENTION

It is accordingly an objective the invention to provide an improved three-dimensional electro-luminescent lighting element capable of emitting light in multiple directions extending over a large arc angle and yet which has a relatively small diameter in comparison with a conventional panel that has been bent into a cylinder, is simple to manufacture, offers customizable output terminal configurations, and eliminates losses resulting from bad terminals permitting replacement during production or assembly simply by stripping wires to obtain new terminals.

It is a further objective of the invention to provide various lighting arrangements incorporating one or more three-dimensional electro-luminescent lighting elements to provide a variety of lighting effects, including multi-color and controlled flashing effects, and yet which is simple to assemble and inexpensive, and which can be applied to a wide variety of objects, including multiple function displays of various kinds, footwear, wearing apparel, bags, greeting cards, toys, vehicles, and numerous other common objects for both indoor and outdoor uses, and which can even be provided in the form of do-it-yourself kits in which terminals easily be added by the user, and which can be "repaired" simply by stripping wires to make new terminals.

It is a further objective of the invention to provide an improved three-dimensional lighting arrangement having increased color choices, including the possibility of dynamically varying the color of light emitted by the element over an angle of from 10° to 360°.

These objectives are achieved, in accordance with the broadest principles of the invention, by providing an electro-luminescent lighting arrangements which employs a coaxial construction made up of a center conductor, surrounding dielectric and phosphor layers, and a coaxial outer conductor to obtain an electro-luminescent lighting element capable of emitting light over an angle of 360°, and yet which has a diameter equal to the diameter of the center conductor and twice the thickness of the surrounding layers, thus providing a three-dimensional electro-luminescent lighting element which is significantly thinner and uses less materials than could be obtained by simply bending a flat panel into a cylinder.

Furthermore, in an especially preferred embodiment of the three-dimensional lighting element of the invention, the inner conductor is in the form of a wire and the outer conductor is in the form of a coil, the ends of which can extend from the element to form flexible leads or to which leads can be attached, by suitable stripping if necessary, anywhere along the length of the element, thus greatly simplifying electrical connection of the electro-luminescent lighting element to the power supply and permitting the element to exhibit such novel effects as flashing while changing colors as different phosphor coatings of the element are triggered or the input current frequency or other parameters are varied.

The three-dimensional electro-luminescent lighting element of the preferred embodiment of the invention can easily be attached to a variety of main objects, for example as piping or decorative strips on the upper surface or inside of the sole of a shoe, within a textile shoe lace, in electrical devices with at least partially transparent housings such as pagers, telephones, cellular phones, watches, table clocks, wall clocks, gift items, garden lighting, and traffic safety lights, with simple electrical connections to the conventional electrical device's power source.

In the case of a timepiece, the three-dimensional electro-luminescent lighting element can increase provide a more attractive lighting performance for the body of a watch while at the same time increasing illumination directions for use in poor lighting conditions, with the driver circuit conveniently being arranged to trigger the lighting element in response to actuation of a push-button or selector switch of the timepiece. In variations of this concept, a table or wall clock can be provided which turns on whenever people walk into the room based on a sound, infrared, photo or other condition-responsive sensor and a day/night control. The changing color features of the three-dimensional electro-luminescent lighting element can be utilized in this application by making the color change responsive to sound, hear, humidity, pressure or weight, music, or any other desired condition.

To attach the three-dimensional electro-luminescent lighting elements of the invention to a variety of different main objects, any of a number standard methods of attaching cylindrically shaped objects or wires to main objects of different shapes may be used, such as are currently used for yard lighting, flag poles, lamp stands, and so forth, or the three-dimensional electro-luminescent lighting element can be positioned in a transparent cylindrical holder which in turn is attached to the main object. Any main object, such a watch, clock, sign, poster, wooden picture frame, radio, stereo, VCR, computer, or the like can be provided with a recess or groove for accommodating the tube-shaped electro-luminescent lighting element to provide a neon-tube like appearance without the high cost of a neon tube, or the hazard to the public presented by glass shards when the neon tube is broken.

Furthermore, by a simple hook and eye arrangement, such as those sold under the trademark Velcro™, or similarly simple attachment arrangements, and by utilizing the simpler and more flexible terminal arrangement of the preferred three-dimensional electro-luminescent lighting element, the element can be used in a variety of do-it-yourself applications, such as for placement on Christmas trees, displays, or ornaments, for use in models such as model railroad layouts, and on street lamps, with electrical connection by quick-release connectors, wire nuts, soldering, clips, or the like, made possible through the use of simple stripped wires as the terminals.

The improved color performance of the preferred three-dimensional electro-luminescent lighting element is made possible, at least in part, by the increased thickness of the conductive layers, which can carry much higher currents and voltages, e.g., 2000 V, than a paper-thin conductive panel. This permits the color spectrum of the phosphor to be determined more precisely, and even allows a purely white light to be emitted if desired. In the case of an electro-luminescent lighting element which emits white light, the element can conveniently be placed inside a larger tube which provides a color filtering effect, and can include masking, stencils, and so forth to provide further decorative effects.

In addition, the inner phosphor layer of the preferred three-dimensional electro-luminescent lighting element can easily be arranged in any desired manner to obtain multiple colors at different points along the length of the element, or multiple lit and non-lit areas, with simple wire connections for each separate phosphor area conveniently being placed in a wire harness or hidden under a surface of the main object to which the three-dimensional electro-luminescent lighting element is attached.

Moreover, dynamic variation of the colors emitted by the preferred three-dimensional electro-luminescent lighting element is achieved by using a variable frequency output circuit to change the color performance of the electro-luminescent lighting elements. The variable frequency output circuit can be incorporated with at least one sensor to trigger the circuit, and be used to control single or multiple tubes, for example by connecting the variable frequency circuit to the output of a radio, computer, car, boat, or home stereo speaker system so that the colors change in response to music.

Thus, in summary, the electro-luminescent lighting element of the invention offers not only the advantage of emitting light in all directions with a smallest possible diameter, but also an improved electrical connection which can easily and safely be carried out by an ordinary consumer, making possible do-it-yourself electro-luminescent lighting kits, and the possibility of dynamically varying the colors, and eliminating losses due to defective pre-set terminals. These advantages are impossible or extremely impractical with conventional flat electro-luminescent panels, even when bent into a complete or partial cylinder.

BRIEF DESCRIPTION OF THE DRAWINGS

FIG. 1D-1 is a diagram illustrating a method of forming new terminals and repairing defective terminals according to the principles of the invention.

FIGS. 6A–6D are perspective views of various roadside safety guides constructed in accordance with the principles of the invention.

DETAILED DESCRIPTION OF THE PREFERRED EMBODIMENTS

Figure 1A:
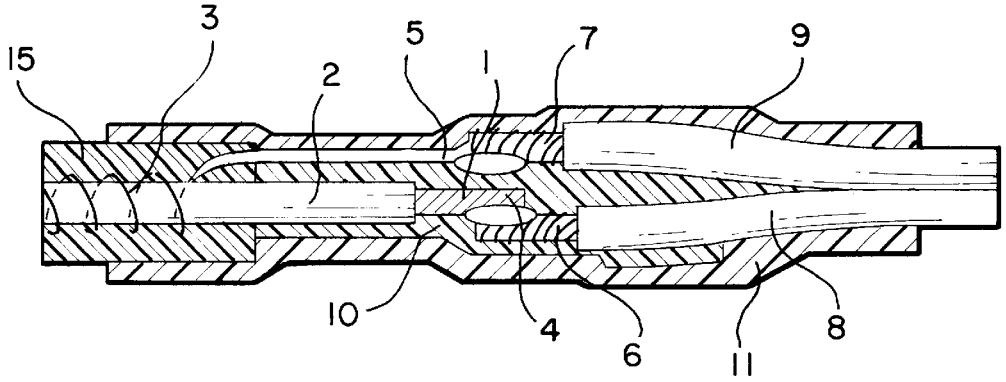
FIG. 1A is a partially cross-sectional view of a three-dimensional electro-luminescent lighting element connected according to the principles of a preferred embodiment of the invention.
Figure 1B:
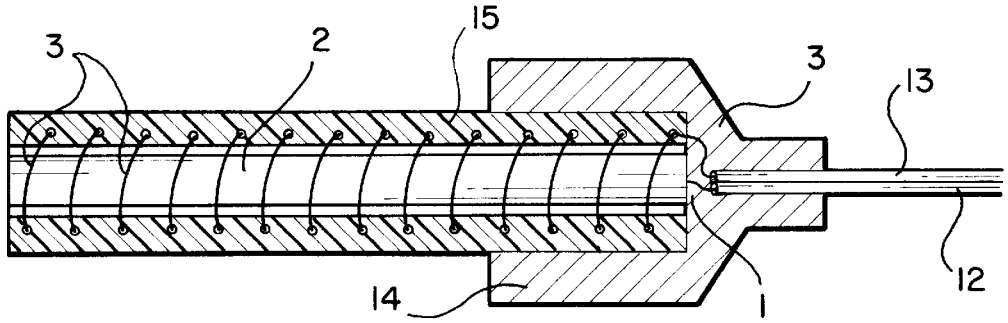
FIG. 1B is a partially cross-sectional view also illustrating an electro-luminescent lighting element constructed and connected according to the principles of a preferred embodiment of the invention.

As illustrated in FIGS. 1A and 1B, the preferred three-dimensional electro-luminescent lighting element includes a center conductor 1 surrounded by at least one set of electro-luminescent layers 2, which in turn is surrounded by an outer conductor 3.

In each of the illustrated variations of the preferred three-dimensional electro-luminescent lighting element, the center conductor 1 in the form of a metal wire or tube-shaped conductor having a diameter sufficient to carry a desired voltage and current, and may be directly coated with the phosphor layer 2, or with a dielectric layer (not shown) on which a phosphor is coated, or with multiple dielectric and/or phosphor layers using any of a variety of known layering techniques, including the techniques described, for example, in entitled "Multiple Segment Electro-Luminescent Lighting Arrangement." The phosphor material may either extend along the entire length of the center conductor, or along portions of the center conductor, and may consist of a single type of phosphor particle or multiple types of particles, or combinations of single and multiple particle coatings.

Surrounding the phosphor/dielectric layers 2 is the outer conductor 3 which may also be in the form of a coating or, as illustrated, a helically wound wire or coil which extends from the end of the electro-luminescent lighting element and which, along with the center conductor, or a wire attached thereto, forms the terminals for the electro-luminescent lighting element.

In the arrangement illustrated in FIG. 1A, the center conductor 1 and outer conductor 3 are soldered at ends 4 and 5 to the conductors 6 and 7 of insulated lead wires 8 and 9, which are encapsulated or otherwise separated from each other by a dielectric 10 and enclosed within a heat shrink tube 11 to form an easily handled and reliable connection, while in the arrangement illustrated in FIG. 1B, the wires of the center conductor 1 and outer conductor 3 are the respective ends of lead wires 12 and 13 which have been stripped of insulation, the point at which the lead wires exit the electro-luminescent lighting element being protected by a sleeve or bushing 14.

It will of course be appreciated that the electrical connections between the center and outer conductors and the respective leads of the element may be effected by any of a variety of methods or means, and that the leads may be attached to the center and outer conductors anywhere along the length of the element, and also at a plurality of locations along the length of the element if individual control of different segments is desired. In all such cases, connection simply involves electrical connection of wires, rather than more sophisticated pre-set terminal attachment methods required in some of the prior flat panel designs, so that new terminals can be created and defective terminals repaired or replaced simply by stripping the wires.

Finally, as shown in both FIGS. 1A and 1B, the three-dimensional electro-luminescent lighting element is surrounded by a protective outer layer 15 made of PVC or a like material. Those skilled in the art will note that, unlike the conventional flat panel, the present invention requires only a single protective layer, thereby saving materials costs and providing improved protection from moisture, over-bending, ultra-violet radiation, and other environmental hazards.

Figure 1C:
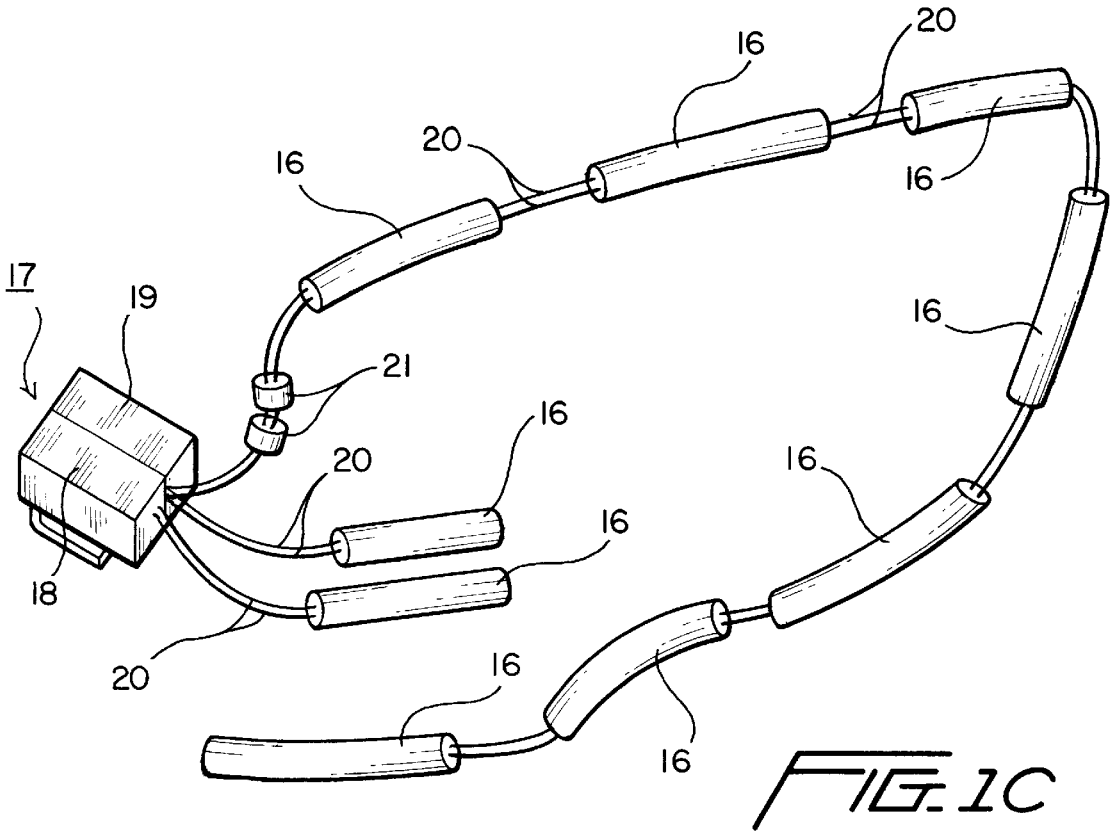
FIG. 1C is a perspective view of a multiple element arrangement of three-dimensional electro-luminescent lighting elements of the type illustrated in FIGS. 1A and 1B, including parallel and series connections.

As illustrated in FIG. 1C, the leads of a plurality of electro-luminescent lighting elements 16 similar to those illustrated in FIGS. 1A and 1B may be connected directly to power pack 17 having compartments for a power supply 18 and control circuit 19, or by inexpensive electric lead wires 20 to other electro-luminescent lighting elements of similar or different colors to form chains or strings of elements, which can be connected in series or in parallel and controlled to provide a variety of different lighting effects, including flashing, steady on, chasing, random, fade in/fade out, color changing, light intensity changing, and partial length lighting effects.

While particular control circuits will be described below, those skilled in the art will appreciate that the control circuit may take a variety of forms, so long as the output of the control circuit has a frequency and voltage sufficient to trigger the electro-luminescent lighting elements by causing a varying electrical field between the center and outer conductors of each element. The power source can either include a DC power source and inverter, or an AC power source, and can be in the form of batteries, a generator, a hook-up to the power grid, or any other convenient source of electrical power.

Finally, as illustrated in FIG. 1C, some of the electro-luminescent lighting elements 16 are conveniently connected to the control circuitry by a quick disconnect electrical connector, although the electro-luminescent lighting elements could of course be wired directly to the control circuit and power supply.

Figure 1D:
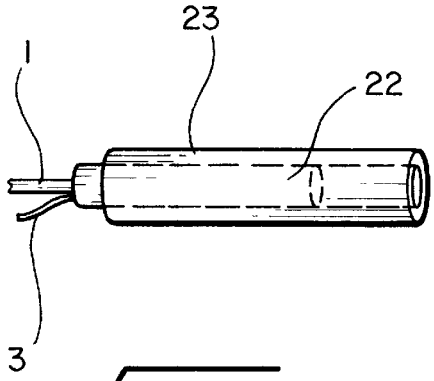
FIG. 1D is a perspective view of a variation of the three-dimensional electro-luminescent lighting element illustrated in FIGS. 1A and 1B, including a colored high transmitivity light tube and a purely white light emitting electro-luminescent tube.

Because the center conductor of the preferred three-dimensional electro-luminescent lighting element does not need to be as thin as the electrode of a flat panel, it is possible to achieve a purely white light electro-luminescent lighting element 22. This offers the possibility of surrounding the elements with masks, filters or colored elements 23 to increase the color choices provided by the elements, as illustrated in FIG. 1D. Normally, different colored electro-luminescent lighting elements require different triggering frequencies, but if the color of the element is determined by a surrounding filter, then a common electrical connection can be used for different colored elements, simplifying the wiring requirements.

Figures 1, 1D:
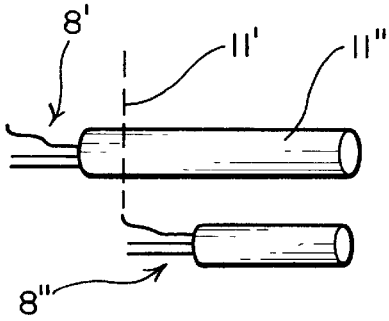

The method of replacing or repairing old terminals is illustrated in FIG. 1D-1. Essentially, the defective terminal 8' is simply cut-off along a cut line 11' and the outer protective layer or layers 11" surrounding the inner and outer conductors is stripped to thereby form new terminal 8". In contrast, when a fixed terminal of a conventional electro-luminescent element has a manufacturing defect or is broken, repair is generally impractical and the entire element must be discarded.

Figure 1E:
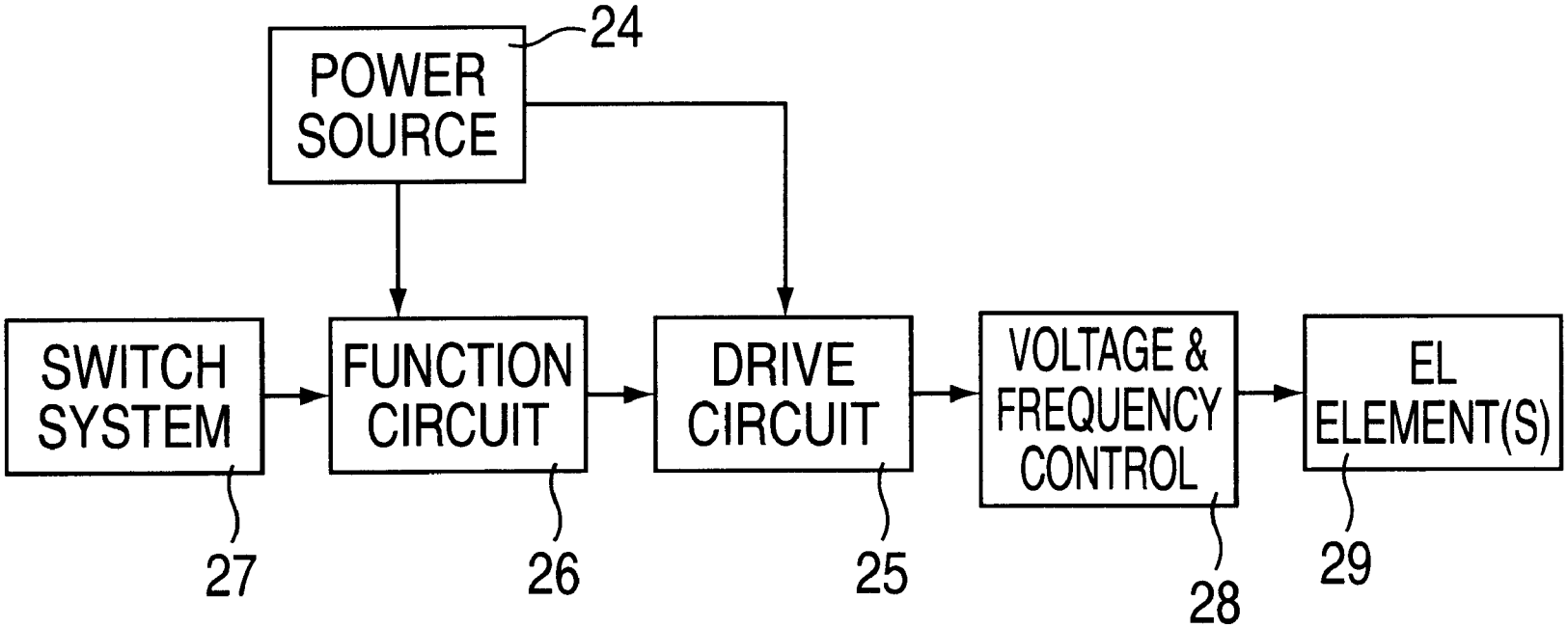
FIG. 1E is a block diagram illustrating a control circuit for the three-dimensional electro-luminescent lighting elements of the preferred embodiments of the invention.

Essentially, as illustrated in FIG. 1E, any electro-luminescent lighting arrangement will require some sort of power source 24, whether in the form of one or more rechargeable or non-rechargeable batteries, a generator, capacitors, the public power supply, or the like, a drive circuit 25 connected to the power source 24, the drive circuit being in the form of an inverter if the power supply is a DC power supply, a function circuit 26 for turning the electro-luminescent on and off via the drive circuit, and which may be at least partly responsive to a switch system 27, a voltage and frequency control or adjustment circuit 28 for converting the output of the drive circuit into a voltage and frequency capable of causing the electro-luminescent lighting elements 29 to emit photons.

Figure 1F:
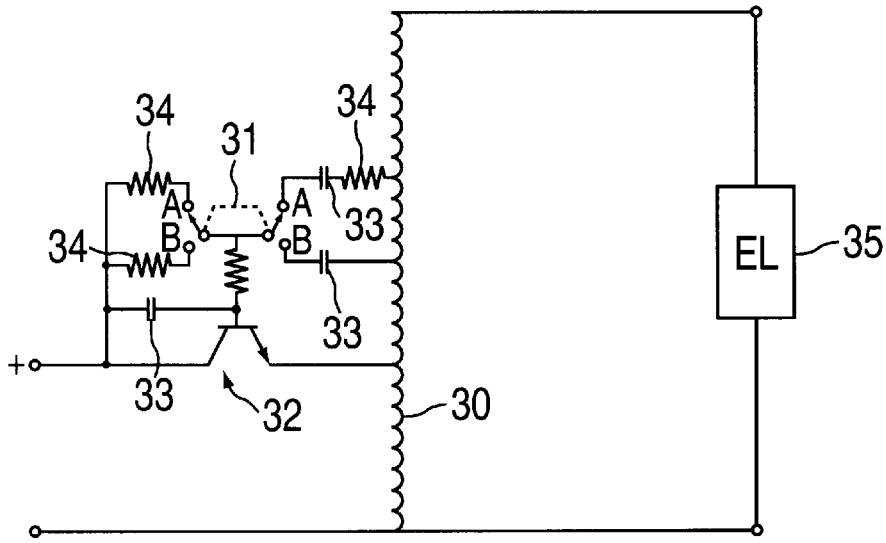
FIG. 1F is a schematic circuit diagram illustrating an example of a basic circuit that could be used in connection with the three-dimensional lighting arrangements of the preferred embodiments of the invention, and which includes a transformer.

One specific example of a suitable basic control circuit is illustrated in FIG. 1F. In this example, the control and power supply circuit includes an inductor/transformer 30, switch 31, transistor 32, three capacitors 33, and three resistors 34, connected to cause the electro-luminescent light 35 to flash or remain steady.

Figure 1G:
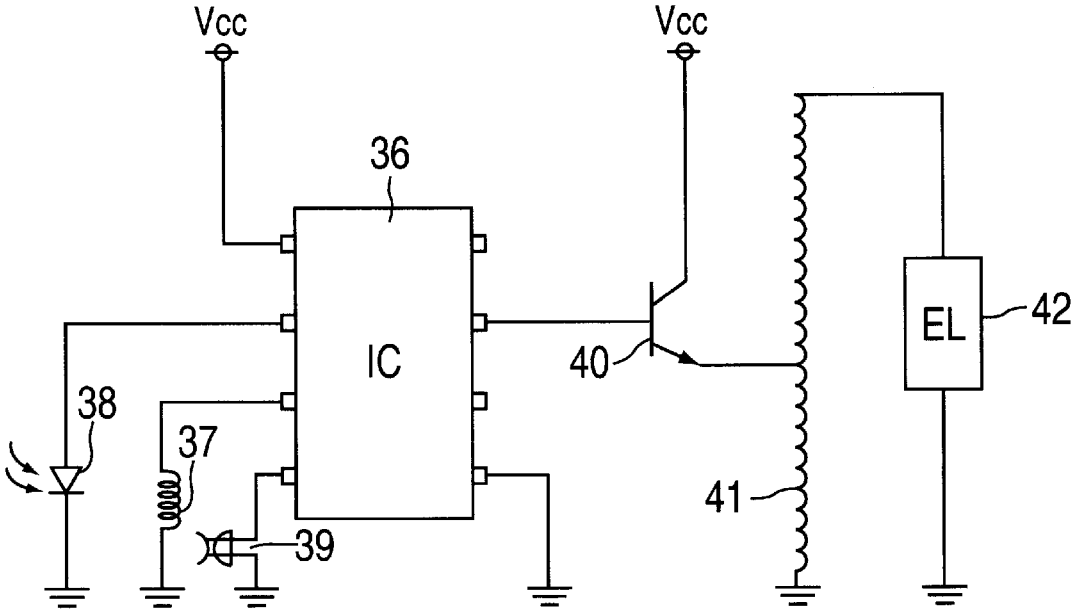
FIG. 1G is a schematic circuit diagram of an alternative circuit which could be used in connection with the three-dimensional electro-luminescent lighting elements of the preferred embodiments of the invention, and which includes and inductor.

Alternatively, as illustrated in FIG. 1G, the control circuit could be in the form of an integrated circuit 36 capable of actuating the switch in a variety of patterns responsive to setting of a selector switch 37, a light sensitive switch 38, and/or a microphone 39, the integrated circuit supplying pulses to cause drive transistor 40 to turn on and off at an appropriate frequency and timing, with the voltage being adjusted by an inductor or transformer 41 connected between the drive transistor 40 and electro-luminescent lighting element 42.

Of course, it will be appreciated that the specific basic circuit elements illustrated in FIGS. 1F and 1G can be replaced by other circuits which perform the functions represented in FIG. 1E, for example by including in the inverter circuit a function interface having means for outputting pulses which enable the electro-luminescent lighting element to be turned on for various periods of time to provide special effects selected from the group consisting of flashing, steady-on, chasing, random, and fade-in/fade-out effects.

Similarly, it will be appreciated by those skilled in the art that the switch used in the various embodiments of the invention can include not only a manual switch, but also one or more mechanical or electric switches sensitive to conditions such as ambient light, vibrations, humidity, heat, sound, tilt, movement of a rolling ball, and so forth.

Turning to FIGS. 2A–2F, which shows one example of an application for the above-described three-dimensional electro-luminescent lighting elements of the invention, in which the three dimensional electro-luminescent lighting elements 43 are used to provide 360° illumination for the face 44 of an analog timepiece (FIGS. 2A–2C) or a digital timepiece or display device (FIGS. 2D–2F), and can be placed essentially anywhere on the face of the timepiece, including around the outer circumference, around any portion of the display 45, or anywhere in between while still illuminating the entire face of the device without the need for a large area flat panel as in the prior art.

Figure 2A:
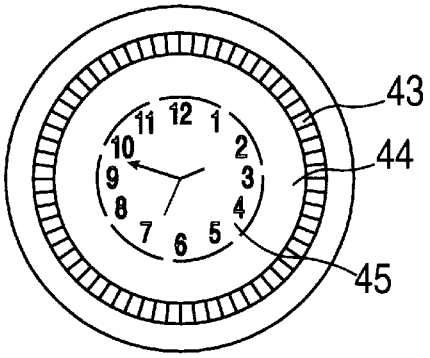
FIGS. 2A–2F illustrate various display arrangements utilizing the three-dimensional electro-luminescent lighting elements of the invention to provide 360° illumination.
Figure 2B:
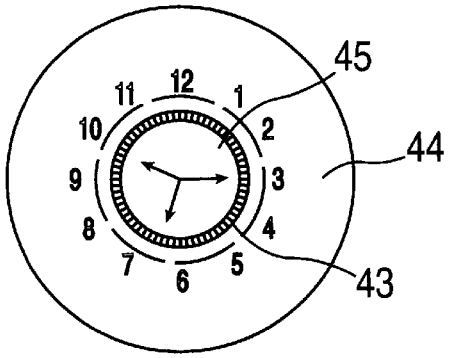
Figure 2C:
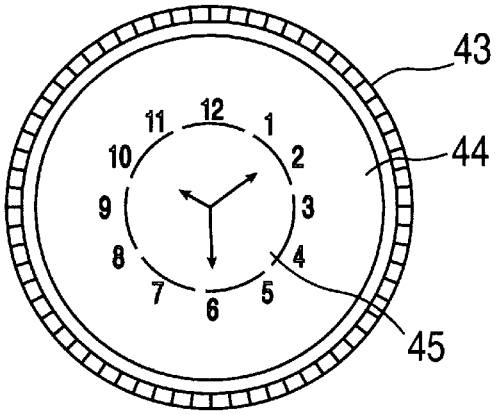
Figure 2D:
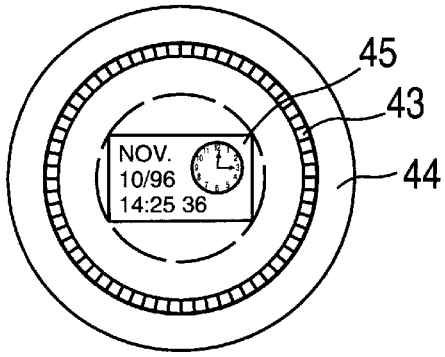
Figure 2E:
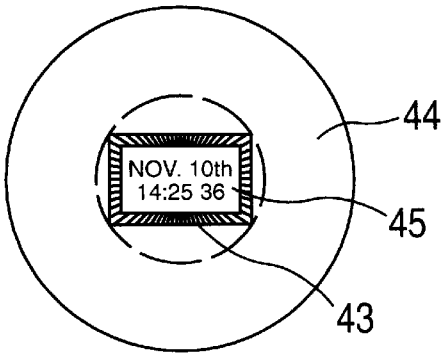
Figure 2F:
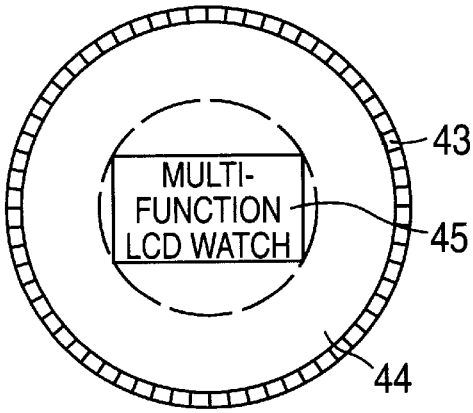
Figures 2G, 2L:
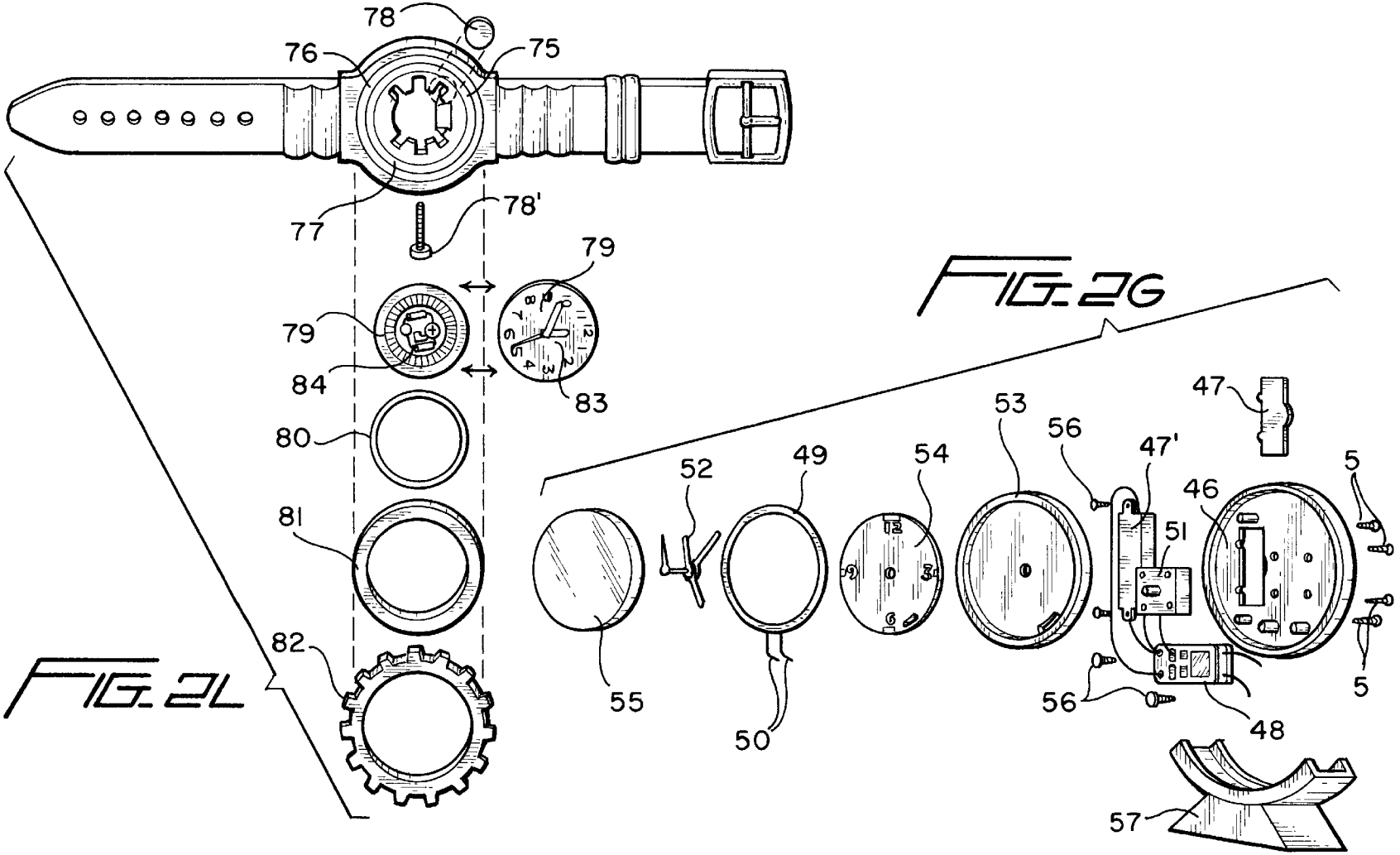
FIG. 2G is a an exploded perspective view of a timepiece constructed according to the principles of the invention.
FIG. 2L is a perspective view showing further alternative timepieces constructed according to the principles of the invention to provide 360° illumination.

As shown in more detail in FIG. 2G, a suitable construction for such a timepiece includes a lower housing 46, including a removable cover for accessing a power source 47', a trigger circuit 48 for the three-dimensional electro-luminescent lighting element 49 including lead wires 50, a mechanism 51 for moving the arms 52 of the time display, a waterproof gasket 53 for sealing the electrical components, a display surface 54 to which the three-dimensional electro-luminescent lighting element 49 attached to the display surface by any suitable attachment means, a lens 55, and attachment screws 56. In case the timepiece is a table clock, a base may selectively be provided.

Figure 2K:
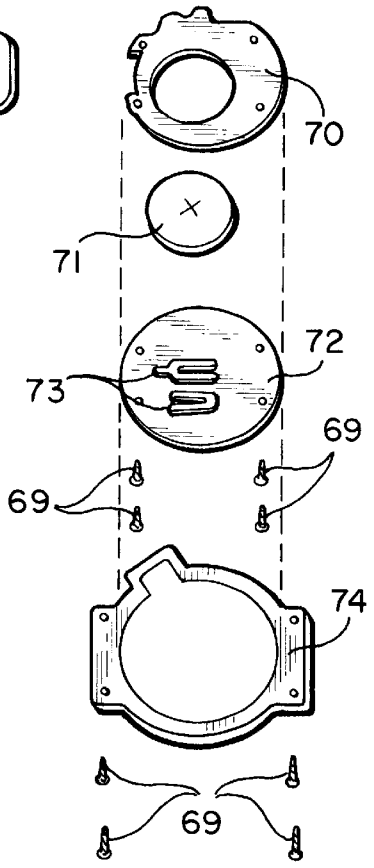
FIG. 2K is an exploded perspective view of additional components of the timepiece of FIG. 2H.
Figure 2H:
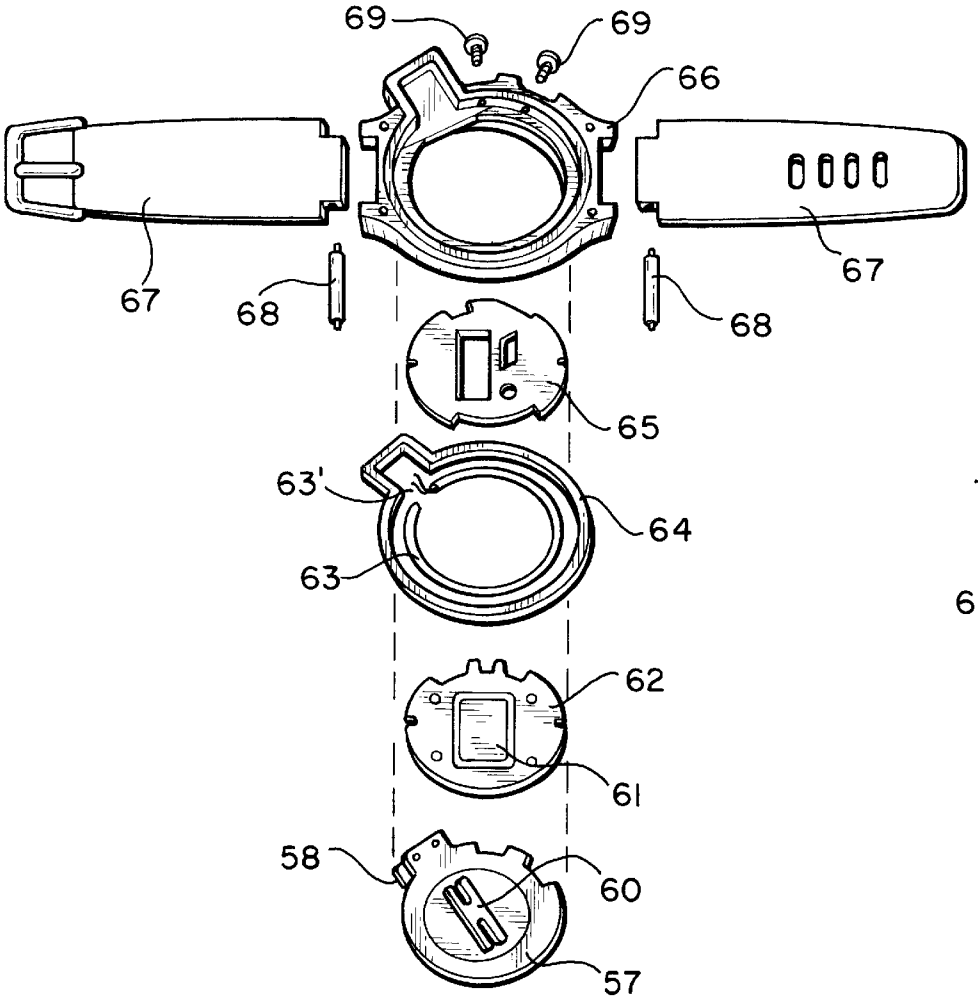
FIG. 2H is an exploded perspective view of an alternative timepiece constructed according to the principles of the invention.
Figure 2J:
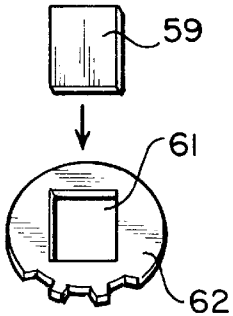
FIG. 2J is a perspective view showing an opposite side of a display mounting arrangement for the timepiece of FIG. 2H.
Figure 2I:
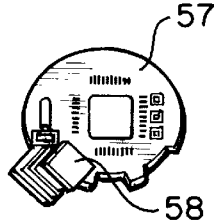
FIG. 2I is a perspective view showing an opposite of a circuit board for the timepiece of FIG. 2H.

In the variation of the analog display device shown in FIG. 2G, illustrated in FIG. 2H, the preferred three-dimensional electro-luminescent lighting element may be used to provide 360° illumination in an LCD multifunction wrist device such as a wristwatch, heart/blood pressure monitor, or the like, having a circuit board 57 supporting as shown in FIG. 2I both the trigger circuitry for the electro-luminescent lighting element (including, for example, a transformer or inductor 58, either conventional or in chip form), and also circuitry for controlling the digital display assembly 59 to be illuminated, as well as battery contacts 60 on an opposite side of the circuit board (FIG. 2H) from the trigger and device circuitry.

In this arrangement, the LCD display assembly 59 is mounted by conventional means in an opening 61 of a support ring 62, which in turn is affixed to circuit board 57. The display is then surrounded by the preferred three-dimensional electro-luminescent lighting element 63, leads 63' of which are connected to the circuit board, and by a gasket 64, and covered by a plate 65, with the entire circuit board and display assembly being fitted into a transparent housing 66 connected in conventional fashion to a wrist band 67 by pins 68, the assembly being secured in the housing by screws 69. Housing 66 may include a groove for positioning the electro-luminescent lighting element 63. Below the circuit board 57 is a battery support 70, battery 71, lower contact plate 72 including contacts 73, and base-plate 74, which are also secured in the housing 66 by screws 69, but which are shown in FIG. 2K. Baseplate 74 completes the device housing.

Because housing 66 of this embodiment is selectively transparent, the three-dimensional electro-luminescent lighting element 63 will shine over an angle of 360° through the housing both to be directly visible, providing an attractive ring of light around the display, and will also provide illumination of the face of the display. This arrangement not only provides more effective lighting, with true neon-type light performance, but also uses less electro-luminescent material than the conventional flat panel arrangement.

In yet another variation of the display device of FIGS. 2A–2H, the three-dimensional electro-luminescent lighting element 75 is situated in a groove 76 of the transparent housing 77 of the display device, which also includes a battery 78, manual input 78', various parts of a digital or analog display 79, gasket 80, removable wheel 81, and wheel cover 82. The display 79 includes a clock face 83 on one side and circuitry 84 for controlling the clock and triggering the electro-luminescent lighting element on the other. It will of course be appreciated by those skilled in the art that the three-dimensional electro-luminescent arrangement can also be arranged on the inner side of the display panel, or between the watch panel and the housing, or at any other locations from which light from the element can provide illumination for the display, including the various locations illustrated in FIGS. 2A–2H.

Figure 3:
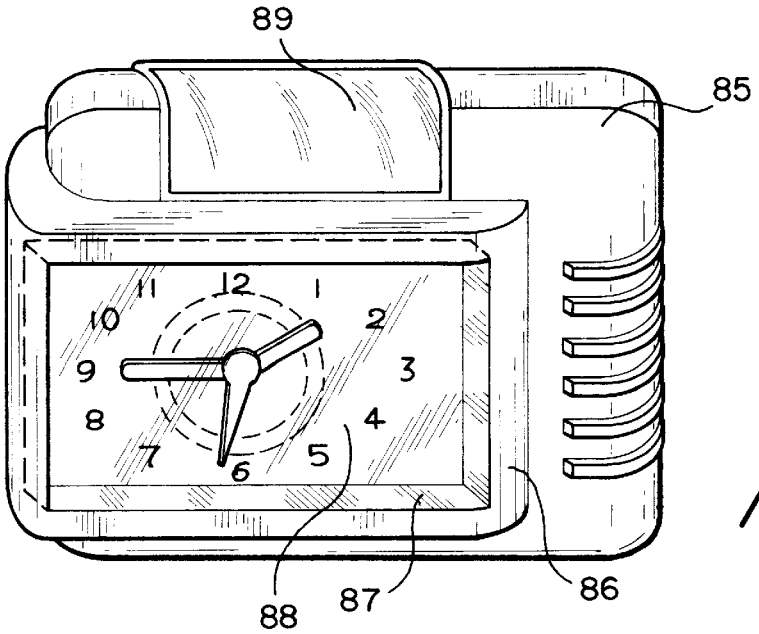
FIG. 3 shows a table clock constructed in accordance with the principles of the invention to provide 360° illumination.

As illustrated in FIG. 3, the three-dimensional electro-luminescent lighting elements of the preferred embodiments of the invention may be included in a table clock 85 either by placing a single element 86 in the housing of the clock around the display, as shown, or by placing a chain of elements connected by wires of the type illustrated in FIG. 1C to lower the cost. An optical lens 87 can be placed between the electro-luminescent lighting element 86 and the display face 88 to enhance the illumination effects.

In addition, in the embodiment of FIG. 3, the three-dimensional electro-luminescent lighting element can conveniently be actuated by a main switch 89 which also serves as a switch for carrying out functions of the clock, so that when the switch is 89 is depressed, the clock face will light up and be visible even in a dark room.

Figure 4A:
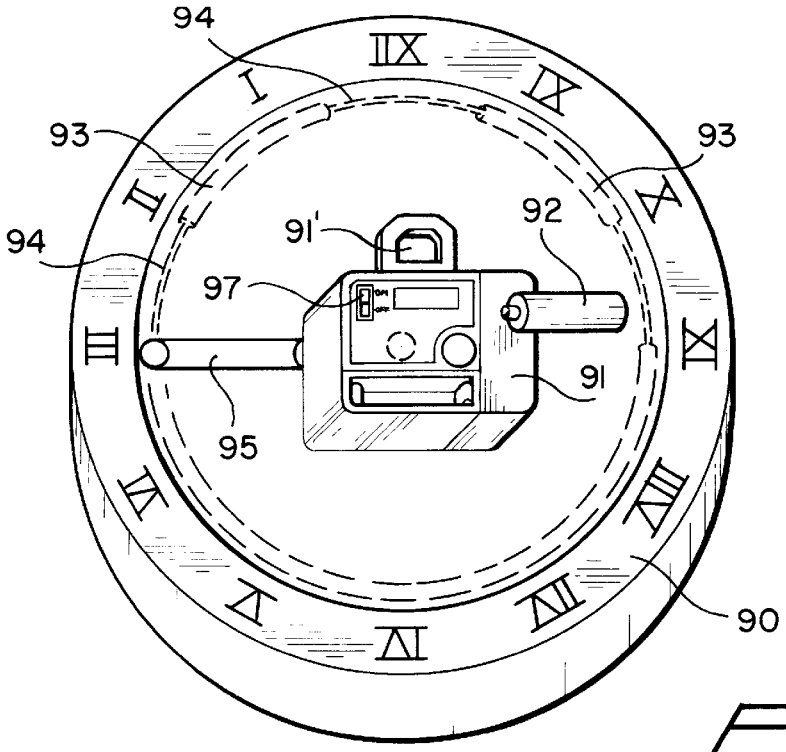
FIG. 4A is a perspective view of the back of a wall clock constructed in accordance with the principles of the invention.
Figure 4B:
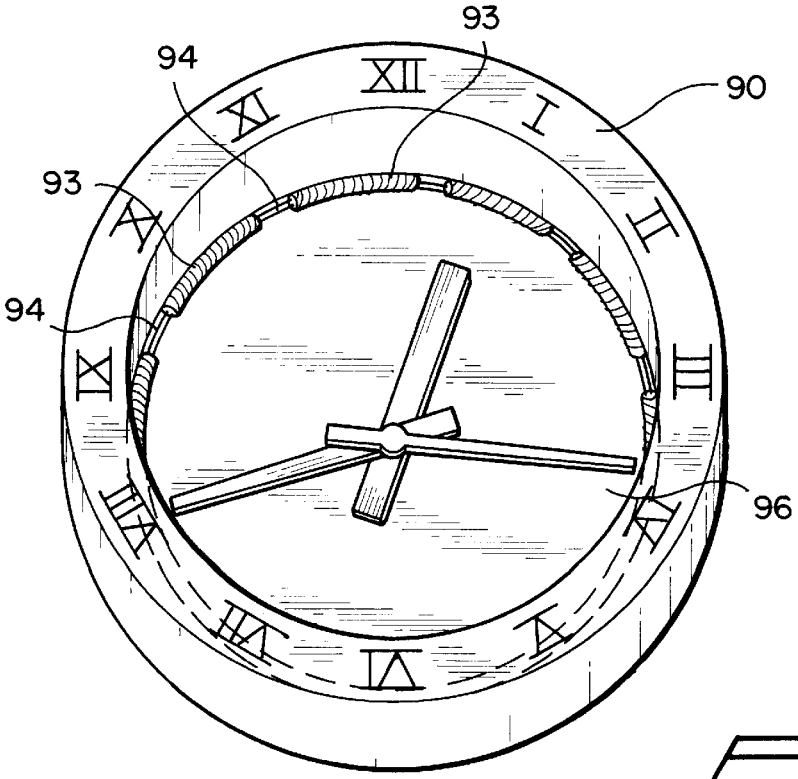
FIG. 4B is a perspective view of the front of a wall clock constructed in accordance with the principles of the invention.

Alternatively, as illustrated in FIGS. 4A and 4B, a similar arrangement can be used for a wall clock 90 having a clock mechanism situated within a conventional housing 91, which supports a hanger 91' and also contains a battery 92, the electro-luminescent lighting element or chain of elements 93 connected by wires 94, the elements 93 also being connected to circuitry in the housing 91 by wires hidden in a groove 95 in the clock face 96. Again, the electro-luminescent lighting element could be actuated by a switch 97 on the clock, or by a sensor switch which could, for example, be arranged to illuminate the clock face whenever a person entered the room in which the clock was hung.

Figure 5A:
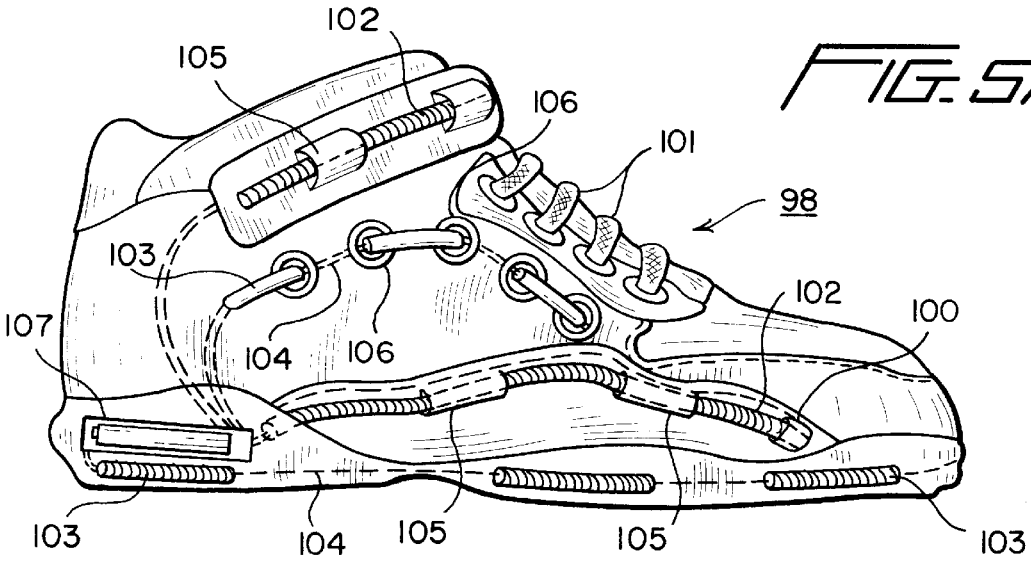
FIG. 5A is a side view of a shoe constructed in accordance with principles of the invention.
Figure 5B:
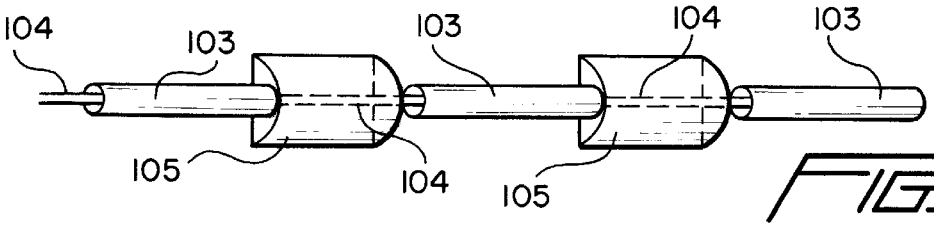
FIGS. 5B–5D are perspective views showing piping arrangements for the shoe illustrated in FIG. 5A or for any other main object having a soft surface.
Figure 5C:
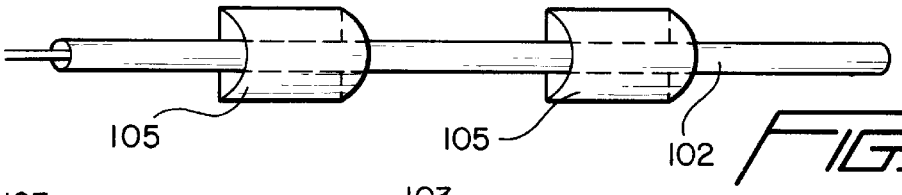
Figure 5D:
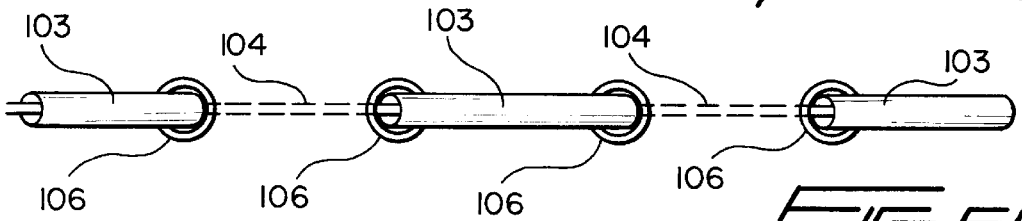

FIGS. 5A–5F show an alternative embodiment of the invention in which the three-dimensional lighting elements are used to illuminate a main object including a portion made of a soft material, represented by shoe 98. In this embodiment, the preferred three-dimensional electro-luminescent lighting elements are used as decorative piping for the exterior of the soft material upper surface 100 of the shoe and also in the laces 101 of the shoe, on the tongue, and around various contours. The piping, shown in detail in FIGS. 5A and 5B, can be attached to the shoe in various ways, and may take the form of either a single extended strip 102, as illustrated in FIG. 5C, or multiple elements 103 connected by wires 104 in the manner illustrated in FIG. 1C. In each case, the piping is threaded through openings in the exterior panels of the shoe which form tunnels 105 for supporting the piping, or through rivet holes 106 as shown in FIG. 5D.

The shoe illustrated in FIG. 5A also includes electro-luminescent lighting elements 103 connected by wires 104 situated in a bottom or sole of the shoe, and a battery packet power supply 107 situated in the heel of the shoe, for example in the manner disclosed in copending application Ser. No. 08/409,625. It will be appreciated by those skilled in the art that the lace illumination arrangement used in the illustrated shoe, which is also suitable for use in a watchband or other band, belt, or strap, can also be in the form either of a single element, or multiple elements connected by wires, and that the illustrated shoe can use any combination, or just one of the above piping arrangements, or variations thereof which may occur to those skilled in the art.

Figure 5E:
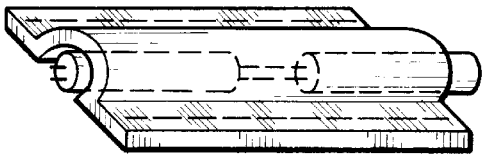
FIGS. 5E and 5F illustrating the manner in which the piping of FIGS. 5B–5D may be attached to the shoe of FIG. 5A or to any other main object having a soft surface.
Figure 5F:
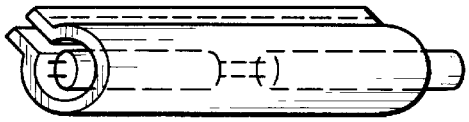

The advantage of using multiple elements connected by wires is of course that the more expensive electro-luminescent material can be limited to exposed areas, with the relatively inexpensive wires traversing the hidden areas. Alternatively, if single electro-luminescent lighting elements are used, the various tunnel forming panels 105' and 105", two of which are shown in FIGS. 5D and 5E, can include both opaque and transparent areas, which may be attached to the shoe upper by any suitable means, including stitching.

Figure 5G:
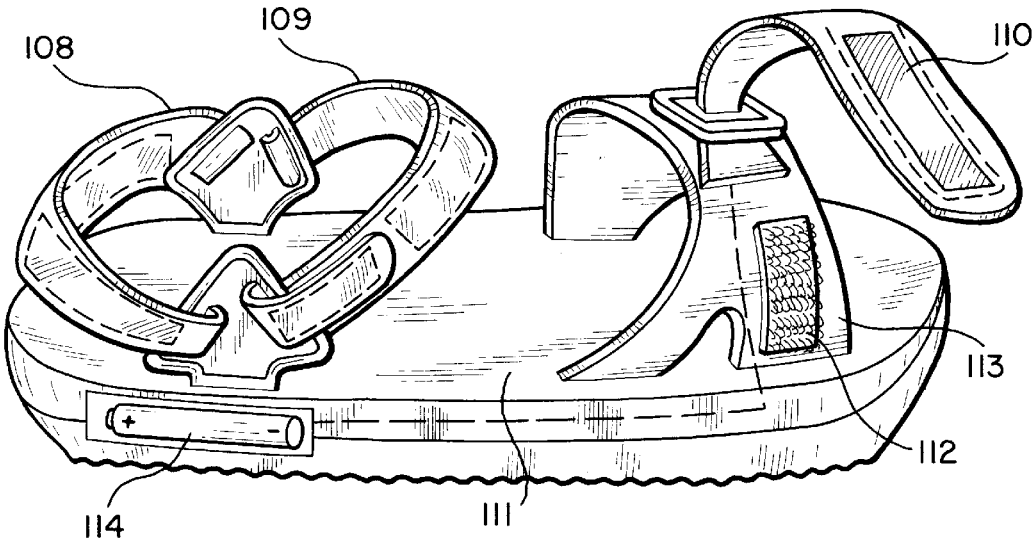
FIG. 5G is a perspective view of a sandal constructed in accordance with the principles of the invention.
Figure 7A:
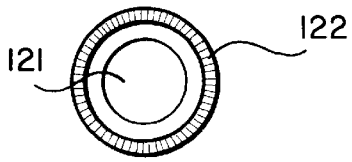
FIGS. 7A–7G are cross-sectional views of various arrangements for attaching the three-dimensional electro-luminescent lighting arrangement of the invention to various objects.
Figure 7B:
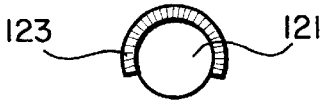
Figure 7C:
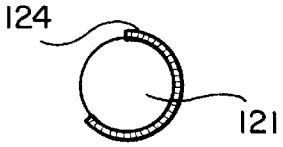
Figure 7D:
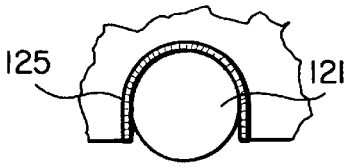
Figure 7E:
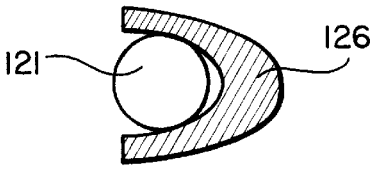
Figure 7F:
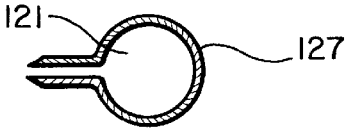
Figure 7G:
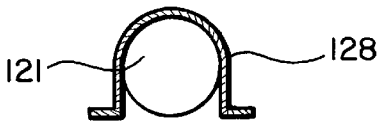

The illuminated piping or straps of this embodiment of the invention can also be used in applications other than shoes, such as bags or clothing, made of any soft material including, but not limited to, textile or woven materials, plastic, leather, and paper. For example, as illustrated in FIG. 5G, the preferred three-dimensional electro-luminescent lighting elements may placed on the straps 108–110 of a sandal 111. The straps of the sandal are conventionally constructed of a thick supporting layer and a soft cushioning layer (not shown), with the front fastening strap 110 further including a layer of fastening material bonded by stitching to the soft cushioning layer so as engage a corresponding fastening material layer 112 on a fixed portion 113 of the sandal. The fastening layer may for example consist of a VELCRO™ hook and loop fastener, using a construction similar to that described in U.S. patent application Ser. No. 08/614,001, while the power pack, including battery 114, can be conveniently supported in a heel or sole of the sandal.

Alternatively, FIGS. 6A–6D illustrate various applications of the three-dimensional electro-luminescent lighting elements 115 of the preferred embodiment of the invention to roadside installations such as a jersey barrier 116, street barricade 117, guard rail installation 118, and traffic cone/barrier set up 119, which are similar to the installations illustrated in copending U.S. patent application Ser. No. 08/498,258. Also illustrated in FIG. 6D is a detour sign in which the letters may be formed by the preferred three-dimensional electro-luminescent strips and the background by corresponding electro-luminescent or photo-luminescent three-dimensional elements or panels. In each of these applications, the electro-luminescent lighting elements or elements are preferably housed in an at least partially transparent flexible containers or sleeves 120.

Because of the flexibility of the preferred design, the lighting elements can be placed on a wide variety of straight and curved surfaces, including various additional safety guides installations illustrated in copending U.S. patent application Ser. No. 08/498,258, as well as in connection with the vehicle lighting arrangement illustrated in U.S. Pat. No. 5,566,384, entitled "Vehicle With EL Strip." Unlike conventional electro-luminescent panels, the three-dimensional electro-luminescent lighting elements 121 of the present invention can be mounted in a variety of different housing configurations or elements 122–128, including circular and semi-circular housings, and in grooves, frames, or envelopes, and so forth, as illustrated respectively in FIGS. 7A–7G. In addition, the fastening means by which the lighting elements are attached to the main object can include clips, hose holders, adhesives, and Velcro™ hook and loop fasteners, preferably extending around less than 180° of the lighting elements.

Figure 8:
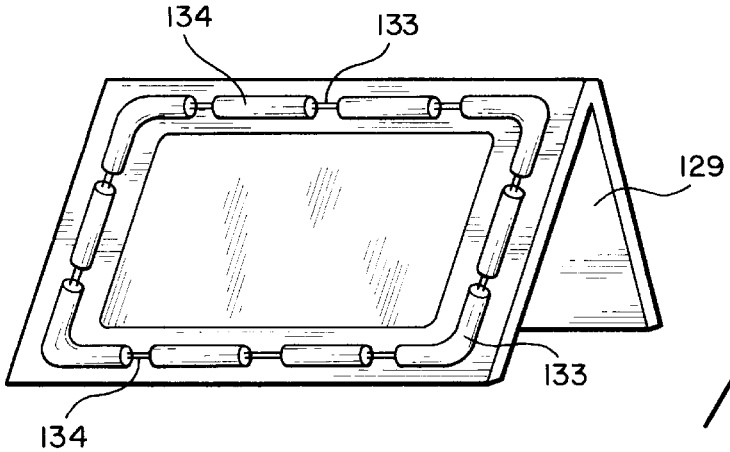
FIG. 8 shows a frame or card constructed in accordance with the principles of the invention.
Figure 9:
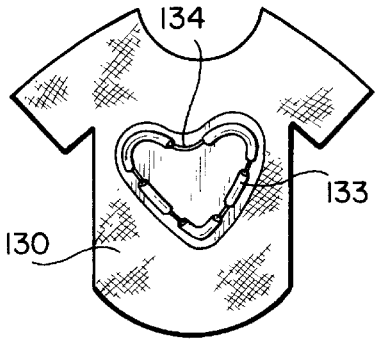
FIG. 9 is a plan view of wearing apparel constructed in accordance with the principles of the invention.
Figure 10:
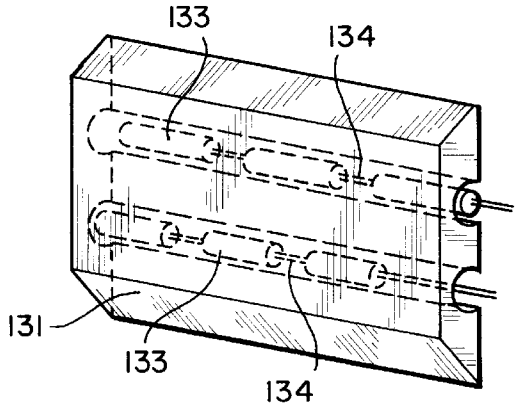
FIG. 10 is a perspective view of a decorative lighting device incorporating the principles of the invention.
Figure 11:
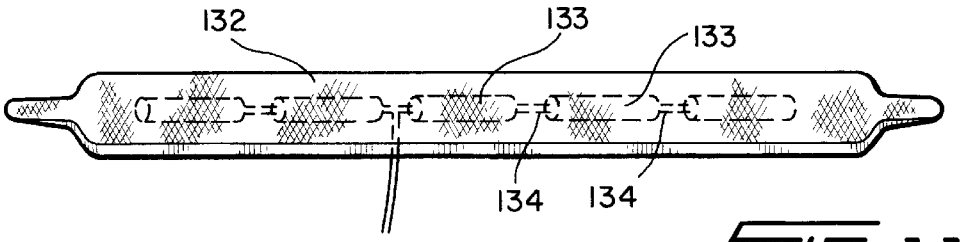
FIG. 11 is a perspective view of a shoelace or watch band incorporating the principles of the invention.

Various additional embodiments of the invention include a picture frame 129 made or wood, plastic, or cardboard, as shown in FIG. 8, a textile item 130 such as a t-shirt, as shown in FIG. 9, a partially transparent main object 131 which could be used, for example, as the side molding of an automobile, as shown in FIG. 10, and a shoe lace 132, as shown in FIG. 11, each of which includes a plurality of three-dimensional electro-luminescent lighting elements 133 connected by wires 134.

Having thus described various preferred embodiments of the invention, those skilled in the art will appreciate that variations and modifications of the preferred embodiment may be made without departing from the scope of the invention. It is accordingly intended that the invention not be limited by the above description or accompanying drawings, but that it be defined solely in accordance with the appended claims.

I claim:

1. A lighting arrangement including a three-dimensional electro-luminescent lighting element, said electro-luminescent lighting element being arranged to emit light in multiple directions without deforming the element, wherein:

the electro-luminescent lighting element includes a center conductor and a coaxial outer conductor having wires that are stripped to form terminals of the lighting element, and further comprising:

electrical circuit means connected to the terminals for supplying electrical power to the electro-luminescent lighting element at a frequency and voltage sufficient to cause the electro-luminescent lighting element to emit light; and attachment means for attaching the electro-luminescent lighting element to a main object to provide illumination for the main object over an arc angle of from 10° to 360°.

2. A lighting arrangement as claimed in claim 1, further comprising a plurality of additional three-dimensional electro-luminescent lighting elements connected to the electrical circuit means by wires.

3. A lighting arrangement as claimed in claim 2, wherein said electrical circuit means includes means for causing at least one of said electro-luminescent lighting elements to turn on or off for periods of time according to a predetermined pattern.

4. A lighting arrangement as claimed in claim 3, wherein said predetermined pattern includes special effects selected from the group consisting of flashing, steady on, chasing, random, fade in/fade out, color changing, light intensity changing, and partial length lighting effects.

5. A lighting arrangement as claimed in claim 2, wherein the lighting elements have different colors.

6. A lighting arrangement as claimed in claim 1, further comprising a plurality of additional three-dimensional lighting elements connected to each other by wires connected to the center and outer conductors of the elements.

7. A lighting arrangement as claimed in claim 6, wherein the lighting elements are connected in series.

8. A lighting arrangement as claimed in claim 6, wherein the lighting elements are connected in parallel.

9. A lighting arrangement as claimed in claim 1, wherein the main object is a timepiece.

10. A lighting arrangement as claimed in claim 9, wherein the timepiece is a wristwatch.

11. A lighting arrangement as claimed in claim 9, wherein the timepiece is a clock.

12. A lighting arrangement as claimed in claim 1, wherein the main object is footwear and the electro-luminescent lighting element is situated at a location selected from the group consisting of an upper surface, outsole, contour, lace, tongue, and decorative strap.

13. A lighting arrangement as claimed in claim 1, wherein the main object is made of a soft material.

14. A lighting arrangement as claimed in claim 13, wherein the soft material is selected from the group consisting of textile materials, woven materials, plastic, leather, and paper.

15. A lighting arrangement as claimed in claim 1, wherein the main object is a decorative side molding of a vehicle.

16. A lighting arrangement as claimed in claim 1, wherein the main object is an electronic device.

17. A lighting arrangement as claimed in claim 1, wherein the three-dimensional electro-luminescent lighting element is situated in an interior of an at least partially transparent housing of the main object.

18. A lighting arrangement as claimed in claim 1, wherein the three-dimensional electro-luminescent lighting element is situated on an exterior surface of the main object.

19. A lighting arrangement as claimed in claim 1, wherein the three-dimensional electro-luminescent lighting element is situated between an edge of the main object and a portion of a display on the main object.

20. A lighting arrangement as claimed in claim 1, wherein the three dimensional lighting element is attached to the main object by threading it through openings in the main object.

21. A lighting arrangement as claimed in claim 20, wherein the openings are selected from the group consisting of cutouts, tunnels, and rivet holes.

22. A lighting arrangement as claimed in claim 1, wherein the main object includes groove extending between 180° and 360° around the three-dimensional electro-luminescent lighting element.

23. A lighting arrangement as claimed in claim 1, wherein the attachment means is selected from the group consisting of clips, hose holders, adhesives, and hook and loop fasteners extending around less than 180° of the three-dimensional electro-luminescent lighting element.

24. A lighting arrangement as claimed in claim 1, wherein the electrical circuit means includes a power supply selected from the group consisting of non-rechargeable batteries, rechargeable batteries, generators, capacitors, and a public power supply.

25. A lighting arrangement as claimed in claim 1, wherein the electrical circuit means includes switch means for changing a characteristic of the three-dimensional electro-luminescent lighting element selected from the group consisting of intensity, brightness, color, and illuminated area in response to an external condition.

26. A lighting arrangement as claimed in claim 1, wherein the three-dimensional electro-luminescent lighting element is arranged to emit white light, and wherein colors are obtained by a tube surrounding the lighting element.

27. A lighting arrangement as claimed in claim 1, wherein the three-dimensional electro-luminescent lighting element is arranged to emit white light, and wherein colors are obtained by a housing of the main object which at least partially surrounds the lighting element.

28. A lighting arrangement as claimed in claim 27, wherein the housing includes means for altering light selected from the group consisting of color filters, stencils, and masks.

29. A lighting arrangement as claimed in claim 1, wherein different colors are obtained by wiring small sections of the three-dimensional electro-luminescent lighting element and controlling a frequency and voltage applied to the sections.

30. A lighting arrangement as claimed in claim 1, wherein different colors are obtained by coating different phosphor materials along a length of the three-dimensional electro-luminescent lighting element.

31. A lighting arrangement as claimed in claim 1, wherein the three-dimensional electro-luminescent lighting element includes a plurality of sections connected by wires and said lighting element is threaded through openings in the main object such that said sections are exposed and said wires are hidden.

32. A lighting arrangement as claimed in claim 1, wherein the main object is a lace of footwear including a passage in which the electro-luminescent element is situated.

33. A lighting arrangement as claimed in claim 1, wherein the main object is a watchband including a passage in which the electro-luminescent element is situated.

34. A lighting arrangement as claimed in claim 1, wherein the main object is a carry strap of a backpack, waistpack, or purse.

* * * * *